United States Patent [19]

Sugiyama

[11] 4,241,503

[45] Dec. 30, 1980

[54] PAIR OF SCISSORS

[75] Inventor: Makoto Sugiyama, Seki, Japan

[73] Assignee: Kaijirushi Hamono Center, Gifu, Japan

[21] Appl. No.: 31,169

[22] Filed: Apr. 18, 1979

[30] Foreign Application Priority Data

Apr. 18, 1978 [JP] Japan ..... 53-44790

[51] Int. Cl.[3] ..... B26B 13/00

[52] U.S. Cl. ..... 30/268

[58] Field of Search ..... 30/267, 268, 270

[56] References Cited

U.S. PATENT DOCUMENTS

| | | | |
|---|---|---|---|
| 444,983 | 1/1891 | Krusius | 30/268 |
| 842,113 | 1/1907 | Pitts | 30/268 |
| 1,422,786 | 7/1922 | Rogers | 30/270 |

*Primary Examiner*—Jimmy C. Peters

*Attorney, Agent, or Firm*—Koda and Androlia

[57] ABSTRACT

A pair of scissors with an adjusting mechanism comprising a bolt to be inserted through openings of blades of the scissors, a fastener engageable with one of said blades, a means for keeping said fastener to be engaged which said blade, and a nut being put around said bolt, said nut being engaged with said fastener, whereby the nut will rotate either to tighten or to loosen the blades by rotating the fastener.

1 Claim, 2 Drawing Figures

PAIR OF SCISSORS

BACKGROUND OF THE INVENTION

1. Field of the Invention

This invention relates to a pair of scissors, and more particularly to a pair of scissors with an adjusting mechanism for their blades.

2. Prior Art

In the prior art, blades of scissors are pivotally united together by means of a nut and a bolt. Therefore, a pair of scissors in the prior art have been suffering from a drawback such that the nut and bolt sometimes get loose during use thereof. This loosening causes some gap between the two blades and deteriorates the cutting efficiency of the scissors. Furthermore, it is almost impossible to keep tightness between the nut and bolt and smoothness in the contact between the two blades unless the nut and bolt is checked and adjusted every once in a while.

SUMMARY OF THE INVENTION

Therefore, it is the primary object of this invention to provide a pair of scissors with an adjusting mechanism for scissors to prevent loosening during use thereof.

It is another object of this invention to provide an adjusting mechanism for scissors which allows the user to select tightness at his choice with very simple operation of the mechanism.

In keeping with the principles of this invention, the objects are accomplished by a unique combination of elements of this invention including a bolt to be inserted into openings of blades, a fastener engageable with one of said blades, a means for keeping said fastener to be engaged with said blade, and a nut being put around said bolt, said nut being engaged with said fastener.

DETAILED DESCRIPTION OF THE DRAWINGS

Figure 1:
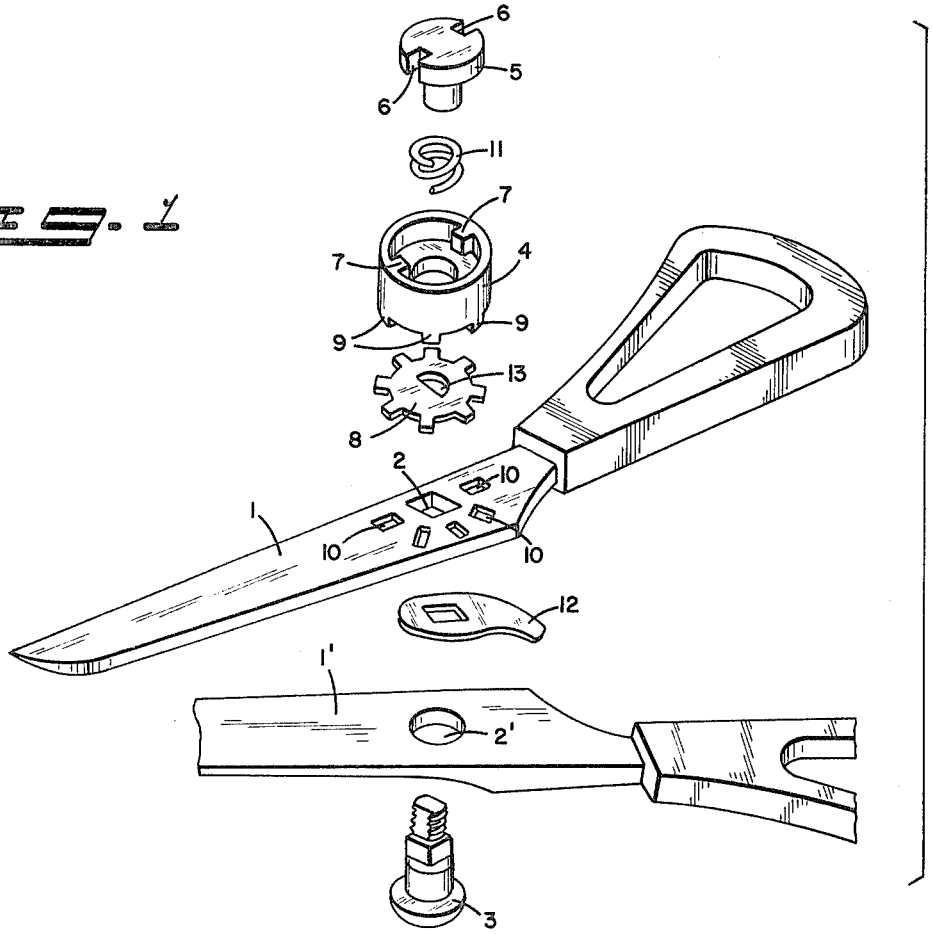
FIG. 1 shows an exploded view of a preferred embodiment of scissors of this invention.

Referring first to FIG. 1, showing a first embodiment a part of second embodiment is also shown of this invention, each one of blades 1 and 1' have openings 2 and 2' therein. A bolt 3 is to be inserted into the openings; however the bolt 3 is so formed as to be rotatable in the opening 2' but not to be rotatable in the opening 2. Around the bolt, there is mounted a ring-shaped fastener 4. The fastener 4 has stopper projections 9 at its bottom to engage with holes 10 provided in the blade 1. Upon the fastener 4, a nut 5 is applied to put on the bolt 3. The nut 5 is so shaped that it engages with the fastener 4, whereby the nut will be rotated by turning the fastener 4. Between the nut 6 and the fastener, there is provided a spring coil 11 which keeps the fastener 4 to be pressed upon the blade 1. A plate spring 12 is placed between the blades 1 and 1' to keep the contact between the blades 1 and 1' tight.

Figure 2:
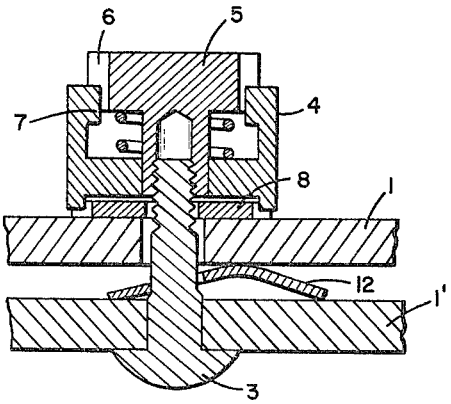
FIG. 2 shows a cross-section view of an adjusting mechanism for the scissors of this invention.

Now referring to FIG. 2, showing the operation of each element of this invention, the bolt 3 is inserted into the openings 2 of the blades 1 and 1', where only the blade 1' is rotatable around the bolt 3. This can be done by having the bolt 3 and the opening 2' of the blade 2 to have a round shape. The plate spring 12 is creating pressure against the blades 1 and 1' to keep the cutting portions (not shown) of the blades 1 and 1' to closely contact with each other. The opening 2 of the blade 2 has a rectangular shape and so has the bolt 3 at its portion corresponding to the opening 2, thereby locking the blade 1. In this embodiment, there is provided a ring-shaped stopper 8 instead of holes 10 in the blade 1. The stopper 8 has teeth therearound such that the teeth engage with the projections 9 of the fastener 4. Since the fastener 4 is pressed by the coil spring 11, the fastener 4 will rotate only with the stopper 8. The stopper 8 has an opening 13 which has a semi-circle shape to closely fit around the nut 3 which also has a semi-circle shape therearound at its corresponding portion. The stopper 8 may be glued to the blade 1 to secure the unity of the stopper 8, the bolt 3 and the blade 1. The fastener 4 has a pair of projections 7 extending inwardly to engage with concaves 6 provided in the nut 5. As a result, if the user rotates the fastener 4, the nut 5 will rotate accordingly. Further, by lifting the fastener 4 against the spring load of the coil spring 11, the fastener 4 will become free from the stopper 8 whereby the user can rotate the fastener 4 alone without rotating the stopper 8 which is united to the blade 1. Therefore, the user can easily adjust the tightness between the blades 1 and 1' by lifting the fastener 4 and then rotating the fastener 4 to either clockwise or counterclockwise causing the nut 5 to tighten or loosen at his choice.

When the fastener 4 is released, it will return to its position to engage with the stopper 8 by the spring load of the coil spring 11. By thus adjusting, the scissors will have a completely proper tightness and will not get loose, since the bolt 3 and the nut 5 are not allowed to rotate relative to each other by means of the engagement of the fastener 4 and the stopper 8.

The fastener 4 and the nut 5 may have other forms of engagement to each other in addition to the projections 7 and the concaves 6.

The number of teeth of the stopper 8 or the holes 10 of the blade 1 may vary as far as there are sufficient number to accomplish the purpose of stopping the fastener 4. The fastener 4 may preferably have a skid-proof surface therearound to make it easier to pinch. The coil spring 11 also may be substituted with means which is made of a resilient material to give pressure upon the fastener 4.

It should be apparent to one skilled in the art that the above described embodiments are merely illustrative of but a few of the many possible specific embodiments of this invention. Numerous and varied other arrangements can be readily devised by those skilled in the art without departing from the spirit and the scope of this invention.

I claim:

1. A scissor comprising:

a first blade member having a round hole therethrough;

a second blade member having a square hole therethrough;

a bolt extending through said holes in said first and second blade members, said bolt including a first portion having a round cross-section which engages with said round hole in said first blade member and a second portion having a square cross-section which engages with said square hole in said second blade member whereby said first portion may rotate relative to said bolt and said second portion is unrotatable relative to said bolt, said bolt further including a third portion having a cross-section substantially equal to a circle with at least one flat side and with threads projecting out of said second blade member;

a spring plate provided between said first and second blade members and having a square hole therethrough which said square portion of said bolt extends;

a ring shaped stopper plate having radially extending teeth and a hole having substantially the same cross-section as said third portion of said bolt therethrough provided on said bolt and engaging against a side of said second blade member, said hole engaging with said third portion of said bolt whereby said stopper plate is unrotatably relative to said bolt;

a cylindrical fastener having downwardly extending teeth and a round hole therethrough, said downwardly extending teeth engaging with spaces between said teeth of said stopper plate, said round hole further engaging with said third portion of said bolt;

a pair of opposing inwardly projecting projections provided on an inner cylindrical surface of said cylindrical fastener;

a nut having a pair of opposing notches provided in an exterior surface of said nut, said nut being screwed onto said third portion of said bolt with said notches engaging with said projections whereby said nut is unrotatable relative to said fasteners; and a coil spring provided about said third portion of said bolt between said nut and said fastener.

* * * * *